US010857573B1

(12) United States Patent
Shapoury

(10) Patent No.: US 10,857,573 B1
(45) Date of Patent: Dec. 8, 2020

(54) METHODS AND APPARATUSES FOR CLEARING PARTICLES FROM A SURFACE OF AN ELECTRONIC DEVICE USING SKEWED WAVEFORMS TO EJECT DEBRIS BY WAY OF ELECTROMAGNETIC PROPULSION

(71) Applicant: The Boeing Company, Chicago, IL (US)

(72) Inventor: Alireza Shapoury, Rancho Palos Verdes, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/444,346

(22) Filed: Jun. 18, 2019

(51) Int. Cl.
*B08B 7/00* (2006.01)

(52) U.S. Cl.
CPC ..... *B08B 7/0035* (2013.01); *B08B 7/0042* (2013.01); *B08B 2215/00* (2013.01)

(58) Field of Classification Search
CPC ..... B08B 7/0035; B08B 7/0042; B08B 3/10; B08B 7/00; H01L 21/67028; H01L 21/6704; H01L 21/02041; H01L 21/02057; H01L 21/0206; H01L 21/02068; H01L 21/02063; H01L 21/02065; H01L 21/02071; H01L 21/02074
See application file for complete search history.

(56) References Cited

U.S. PATENT DOCUMENTS

2017/0133202 A1* 5/2017 Berry, III ..... H01J 37/32238

FOREIGN PATENT DOCUMENTS

JP 2001-242097 * 9/2001

OTHER PUBLICATIONS

Machine Translation of JP2001-242097 by Miyashita et al., published Sep. 7, 2001.*

* cited by examiner

*Primary Examiner* — Douglas Lee
*Assistant Examiner* — Ryan L. Coleman
(74) *Attorney, Agent, or Firm* — McDonnell Boehnen Hulbert & Berghoff LLP

(57) ABSTRACT

In examples, systems and methods for using skewed waveforms to eject debris using electromagnetic propulsion are disclosed. The systems and methods include a first electronic device having a surface. The systems and methods also include a signal generator configured to generate a skewed signal configured to cause a movement of particles on the surface of the first electronic device. Additionally, the systems and methods include an antenna coupled to the signal generator, where the antenna is configured to receive the skewed signal from the signal generator and radiate the skewed signal as electromagnetic energy proximate to the surface of the first electronic device.

20 Claims, 6 Drawing Sheets

METHODS AND APPARATUSES FOR CLEARING PARTICLES FROM A SURFACE OF AN ELECTRONIC DEVICE USING SKEWED WAVEFORMS TO EJECT DEBRIS BY WAY OF ELECTROMAGNETIC PROPULSION

FIELD

Embodiments of the present disclosure relate generally to removing debris from a surface. More particularly, embodiments of the present disclosure relate to using electromagnetic propulsion to remove debris from the surface.

BACKGROUND

Electromagnetic waves are electromagnetic energy that propagates through a medium and carry energy. Often, electromagnetic waves are used for long-range communication and direction finding, such as for communication by mobile phones and radar systems. Because electromagnetic waves have energy, they may exert a force upon other objects when the two collide.

SUMMARY

In one example, an apparatus for electromagnetically removing particles from a surface is described. The apparatus includes a first electronic device having a surface. The apparatus also includes a signal generator configured to generate a skewed signal configured to cause a movement of particles on the surface of the first electronic device. Additionally, the apparatus includes an antenna coupled to the signal generator, where the antenna is configured to receive the skewed signal from the signal generator and radiate the skewed signal as electromagnetic energy proximate to the surface of the first electronic device.

In another example, a method of electromagnetically removing particles from a surface is described. The method includes generating a skewed signal configured to cause a movement in the particles. The method further includes feeding the skewed signal to an antenna. Additionally, the method includes radiating, from the antenna, the skewed signal proximate to the surface.

In another example, another method of electromagnetically removing particles from a surface is described. The method includes determining a size of the particles. The method also includes generating a skewed signal configured to cause a movement in the particles based, at least in part, on the determined size. Additionally, the method includes feeding the skewed signal to an antenna. The method also includes radiating, from the antenna, the skewed signal proximate to the surface.

The features, functions, and advantages that have been discussed can be achieved independently in various embodiments or may be combined in yet other embodiments further details of which can be seen with reference to the following description and drawings.

BRIEF DESCRIPTION OF THE FIGURES

Example novel features believed characteristic of the illustrative embodiments are set forth in the appended claims. The illustrative embodiments, however, as well as a preferred mode of use, further objectives and descriptions thereof, will best be understood by reference to the following detailed description of an illustrative embodiment of the present disclosure when read in conjunction with the accompanying drawings, wherein:

DETAILED DESCRIPTION

Figure 1A:
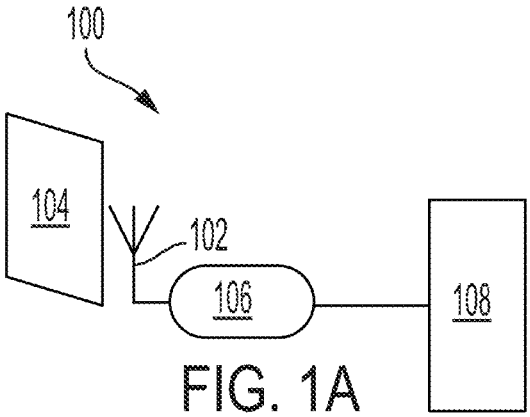
FIG. 1A illustrates an example antenna arrangement, according to an example embodiment.

Disclosed embodiments will now be described more fully hereinafter with reference to the accompanying drawings, in which some, but not all of the disclosed embodiments are shown. Indeed, several different embodiments may be described and should not be construed as limited to the embodiments set forth herein. Rather, these embodiments are described so that this disclosure will be thorough and complete and will fully convey the scope of the disclosure to those skilled in the art.

Removing particulate debris from surfaces may pose a difficult challenge in some circumstances. For example, man-made objects in space may collect space dust or other particles on their surface. Similarly, when fabricating silicon wafers, dust or other particles may collect on the surface. Removing these particles without the need for a mechanical removal system may be desirable. A mechanical removal system may be complicated, expensive, damage the surface, and may not be reasonable with small particle sizes, such as a few molecules up to 0.1 micrometers.

The present system may be used for removing particles from a surface, such as a sensor surface or a surface protecting a sensor. Unlike conventional mechanical particle-removing devices and methods, the present disclosure is directed toward using electromagnetic energy to remove particles from the surface. Additionally, some conventional particle-removing system use corona discharge or high-energy plasma for particle removal. The high energy and field levels created by both corona discharge and high-energy plasma may be undesirable for some applications, including applications where power is limited and/or electronic components are sensitive.

Rather than relying on a physical removal of particles, such as through brushing, the present disclosure uses at least one antenna and transmitting a specially-designed waveform to remove the particles from the surface using the Lorentz force. The particles may be pushed by the Lorentz force in the direction of the electromagnetic propagation. Moreover, the waveform may be created to push a wide range of particles with velocities that exceed the velocity that would be achieved by a conventional sinusoidal signal. The antenna may be located proximate to the surface and be configured to transmit electromagnetic energy in a direction of the surface. In some examples, the antenna may be configured to transmit the electromagnetic energy parallel to and across the surface.

In some examples, the surface may have undesired particles or ions located on it, such as dust or other debris. In these examples, the particles may be ionized (i.e., they have a charge and/or are ions). When the electromagnetic energy strikes the charged particle, the electromagnetic energy may impart a force on the particle and cause it to move. In another example, the particle may not inherently have a charge. In this example, a laser (or other device) may impart a charge on the particle to ionize it before the electromagnetic energy causes the particle to move. In yet another example, a laser may be used for laser ablation to remove material from the surface. The electromagnetic energy may be used to move the particles that have been removed from the surface.

In some examples, the surface may be the surface of an electronic device, such as a solid state wafer, a sensor, or other electrical component where removing debris is desirable. In another example, the surface may be a covering or a protective layer on top of a sensor, such as a lens or coating on top of an optical sensor.

The antenna system of the present disclosure may be a single antenna or it may be an array of antennas. The array of antennas may be able to steer a direction of the transmission of electromagnetic energy. Further, in some examples, the antenna system may be able to change a polarization of the transmitted electromagnetic energy. Additionally, the beam from the antennas may be directed in a way where energy transmitted into the electronic device may be minimized.

In some examples, the present system may be triggered to perform the particle-movement operations at predetermined time intervals. In another example, the present system may be triggered to perform the particle-movement operations based on an indication of debris on the surface. The indication may be provided by a camera, a sensor measurement (such as the impairment of a sensor), or a measurement of electrical properties of the surface (as particles may cause a change in the electrical measurements of the surface). In yet another example, the present system may be triggered manually.

Referring now to the figures, FIG. 1A illustrates an example antenna arrangement 100 including an antenna 102, a surface 104, a signal generator 106, and a signal controller 108. The antenna 102 may be aligned so that transmissions of electromagnetic energy from the antenna 102 propagate in a direction across the surface 104.

The antenna 102 may be coupled to a signal generator 106. The signal generator 106 may be a piece of hardware that outputs an electromagnetic signal. In some examples, the signal generator 106 may receive an input that specifies parameters of the signal that the signal generator should output. The signal generator 106 may be configured to generate a skewed signal for transmission by the antenna 102. In some examples, the signal generator 106 may include a signal amplifier (not shown) as well. The signal amplifier may be configured to amplify a signal created by the signal generator 106 to a desired transmission power.

Additionally, the antenna 102 or the signal generator 106 may include a filter (not shown). In some other examples, the filter may be a discrete component. The filter may be a tunable filter. The filter may be configured to prevent the antenna from transmitting certain frequencies. The filter may prevent the antenna from transmitting frequencies that can interfere with other components of the system, include a sensor having the surface (or located below the surface), frequencies with which the system communications, or frequencies with which the system makes measurements. Other example frequencies are possible as well. Additionally, in some examples a tunable filter may be controlled by a processor of the system to control which frequencies the filter blocks or passes.

The signal generator 106 may be coupled to a signal controller 108. The signal controller 108 may be a computing device configured to determine the skewed signal. As such, the signal controller 108 may include one or more processors, and instructions stored on non-transitory computer readable medium that are executable by the one or more processors to perform functions of the signal controller 108 described herein. In some examples, the signal controller 108 may be omitted and the signal generator 106 may be able to generate a skewed signal on its own. In another example, the signal controller 108 may be combined with the signal generator 106. In yet another example, the signal controller 108 may be coupled to a camera (not shown). The camera may be used to help determine a particle size.

The signal controller 108 may generate a skewed signal based in part on a size, density, or material properties of the particles. The signal controller 108 may instruct the signal generator 106 with parameters designed to move the particles. For example, the signal controller 108 may specify a waveform or coefficients for a waveform that the signal generator 106 may use to generate the signal for transmission by the antenna 102.

Figure 1B:
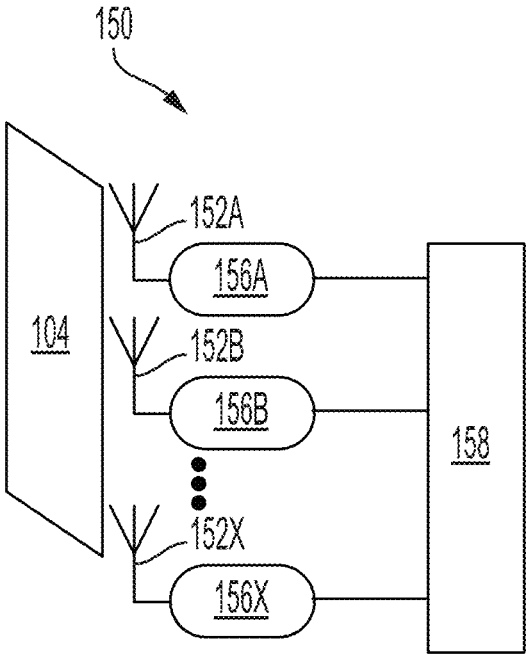
FIG. 1B illustrates another example antenna arrangement, according to an example embodiment.

FIG. 1B illustrates another example antenna arrangement 150 including a plurality of antennas, including antenna 152A, antenna 152B, and antenna 152X, a surface 104, a plurality of signal generators, including signal generator 156A, signal generator 156B, and signal generator 156X, and a signal controller 158. The plurality of antennas may be aligned so that transmissions of electromagnetic energy from the plurality of antennas propagate in a direction across the surface 104. Moreover, the plurality of antennas may be formed in an array, shown by antenna 152A, antenna 152B, and antenna 152X. Although three antennas are shown, more or fewer may be used in various different examples.

Each antenna from the plurality of antennas may be coupled to a respective signal generator. Antenna 152A may be coupled to a signal generator 156A, antenna 152B may be coupled to a signal generator 156B, and antenna 152X may be coupled to a signal generator 156X. Although the signal generators are shown as separate signal generators, in some examples, there may be one or more signal generators configured to feed multiple antennas.

Each signal generator may be configured to generate a skewed signal for transmission by respective antenna coupled to the signal generator. As previously discussed, the signal generators may include a respective signal amplifier (not shown) as well. The signal amplifier may be configured to amplify a signal created by the signal generator to a desired transmission power.

The signal generators may be coupled to a signal controller 158. The signal controller 158 may be a computing device configured to determine the skewed signal for transmission by each antenna of the plurality of antennas. In some examples, the signal controller 158 may be omitted and the one or more signal generators may be able to generate a skewed signal on their own. In another example, the signal controller 158 may be combined with the plurality of signal generators as a single unit. In yet another example, the signal controller 158 may be coupled to a sensing component (not shown) such as a camera, an electromagnetic probe, or compact radar. The camera may be used to help determine a particle size. The particle size and amount may also be measured indirectly (for example, by measuring the energy generated by e.g., the photovoltaic system that we want to protect).

As previously discussed with respect to FIG. 1A, the signal controller 158 may generate a skewed signal based in part on a size, density, or material properties of the particle. The signal controller 158 may instruct the one or more of signal generators with parameters designed to move the particle. For example, the signal controller 158 may specify a waveform or coefficients for a waveform that the one or more signal generators may be used to generate the signal for transmission by the plurality of antennas.

Additionally, the signal controller 158 may be configured to instruct the one or more signal generators to provide a relative phasing for each of the plurality of antennas. By providing a relative phasing, a beam transmitted by an array comprising the plurality of antennas may be controlled. For example, by dynamically adjusting the phasing, the beam of radiated electromagnetic energy may be steered across surface 104. In some examples, the beam may be steered to a specific location on the surface 104 where a particle to be moved is located. In other examples, the beam may be steered to sweep across all of or a portion of the surface 104 to move particles.

Figure 2:
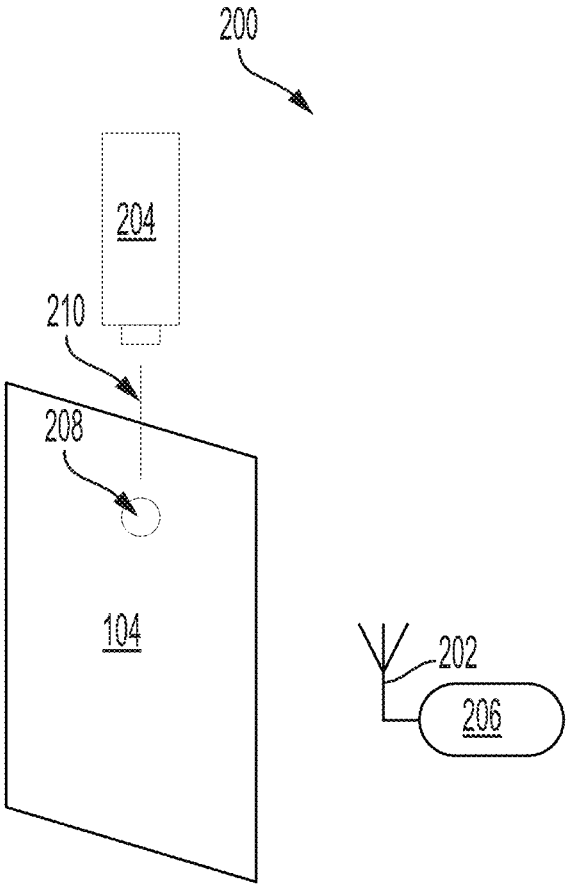
FIG. 2 illustrates an example system having a laser, according to an example embodiment.

FIG. 2 illustrates another example system 200 having an antenna 202 and a laser 204, according to an example embodiment. The example system 200 may include a surface 104, an antenna 202, a laser 204, a signal generator 206, and a particle 208. The surface 104 may be same as the surfaces described with respect to FIGS. 1A and 1B. Additionally, the antenna 202 may take the form of a single antenna, like antenna 102 of FIG. 1A, or the antenna 202 may take the form of an antenna array, like the plurality of antennas forming an array of FIG. 1B. Also, the signal generator may take the form of the signal generators disclosed with respect to FIGS. 1A and 1B. Moreover, signal generator 206 may be coupled to a signal controller (not shown) similar to signal controller 108 or signal controller 158.

As shown in FIG. 2, there may be a laser 204 located near the surface 104. The laser may operate in one of at least two different modes. In a first mode, the laser 204 may shine a laser beam 210 on to surface 104 to ionize particles on the surface, such as particle 208. By ionizing particles, particles that have no charge will become charged (i.e., become an ion). Once the particles are charged, the electromagnetic energy transmitted by the antenna 202 may cause the ionized particles, such as particle 208, to move. The movement may be in a direction away from the surface 104. In a second mode, the laser 204 may shine a laser beam 210 onto surface 104 to laser ablate a portion of the surface 104. Laser ablation may be used to remove some particles from the surface. When particles, such as particle 208, are removed from the surface through laser ablation, the particles may remain on the surface 104. The electromagnetic energy transmitted by the antenna 202 may cause the removed particles, such as particle 208, to move. In another example, once the laser 204 removes particles from the surface through ablation, the laser may again shine the laser beam 210 on the particle 208 to ionize the particle. Thus, the ionized particles may then be removed from the surface by the electromagnetic energy from the antenna 202. In some examples, to alternate between the first and second modes, a power level of the laser may be adjusted. In other examples, a frequency of operation and a power level may be adjusted between the two modes.

In some examples, the laser may also include a polarizer. When using ionizing lasers (for example, an ultraviolet laser), a polarizer may be located in front of the laser and the laser may be angled at Brewster angle, with respect to the surface. By angling the laser, it may cause the laser light to reflect from the surface and not penetrate (or refract) into the electronics or apertures that form (or are located under) the surface.

Figure 3:
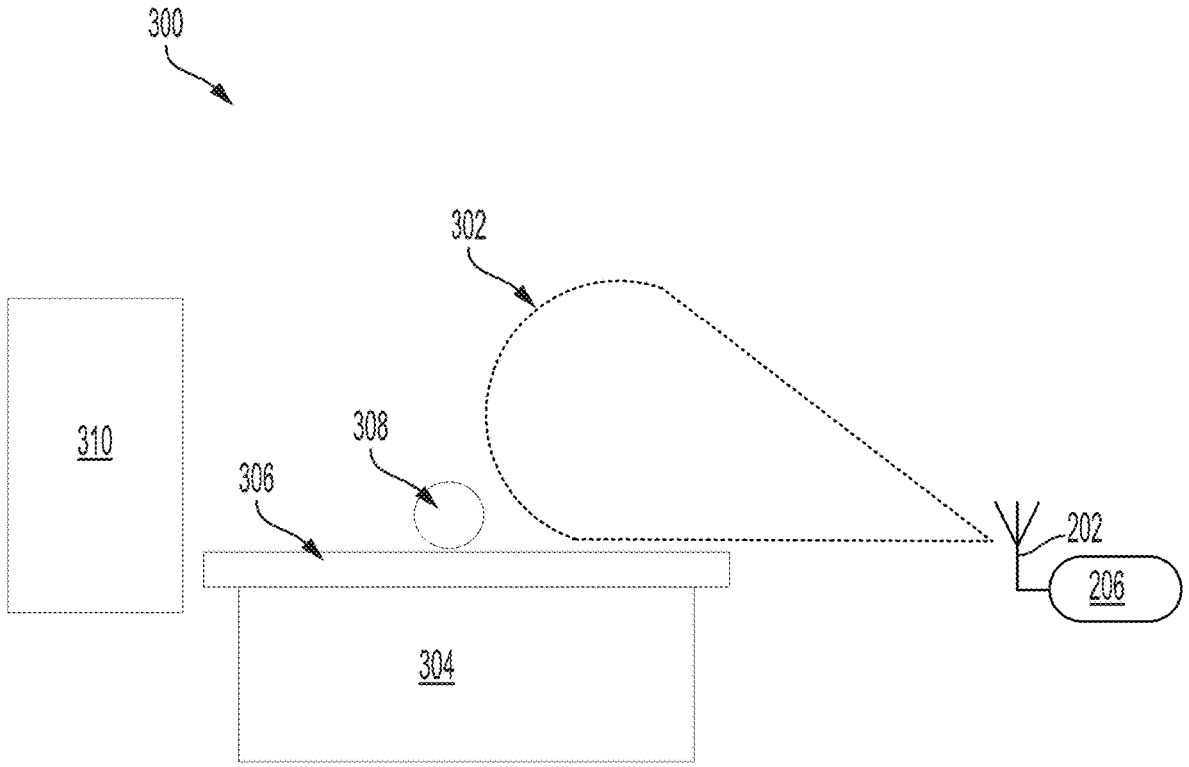
FIG. 3 illustrates an example side view of a system, according to an example embodiment.

FIG. 3 illustrates an example side view of a system 300, according to an example embodiment. The system 300 may include an antenna 202 coupled to a signal generator 206. The antenna 202 may transmit an electromagnetic signal having a radiation pattern 302. Additionally, the system may include an electronic device 304 having a surface 306. There may be a particle 308 located on the surface 306. The radiation pattern 302 of the antenna 202 may be directed in a direction where the amount of electromagnetic energy radiating into the electronic device 304 may be minimized. Therefore, it may be desirable for the radiation pattern 302 to have both a narrow beamwidth and relatively low side lobes. Additionally, in some examples, the antenna may include a polarization that is parallel to the plane of the surface 306.

As previously discussed with respect to FIG. 2, antenna 202 and signal generator 206 may take the form of any of the antennas and signal generators disclosed in FIGS. 1A and 1B. In some examples, antenna 202 of FIG. 3 may be a single antenna element. In this example with a single antenna element, the radiation pattern 302 may have a fixed direction. In other examples, antenna 202 of FIG. 3 may be an array of antenna elements. In this example with an antenna array, the radiation pattern 302 may either have a fixed direction or the radiation pattern 302 may be steered. Depending on the arrangement and signaling provided to antenna elements that form the antenna array, the radiation may be steered in elevation, azimuth, or both elevation and azimuth.

Shown in FIG. 3 is an electronic device 304 having a surface 306. In some examples, the electronic device 304 and the surface 306 are separate elements, such as a light sensor for the electronic device 304 and a lens or covering for the surface 306. In other examples, the surface 306 may be the top surface of the electronic device 304 itself, such as the top surface of a silicon wafer.

There may be a particle 308 located on the surface 306. The particle 308 may be an undesired particle, such as dust or debris, or a particle from the surface 306 itself, such as particle formed from laser ablation of the surface 306. When transmitted electromagnetic energy from the antenna 202 strikes the particle, it may cause a movement of the particle 308 via an electromagnetic force. Thus, the electromagnetic energy from the antenna 202 may remove particles from the surface 306.

In some examples, the electromagnetic energy from the antenna 202 may move the particle 308 toward a collection unit 310. The collection unit 310 may have an electrostatic charge designed to hold the particles that are pushed toward it. Thus, the collection unit may be used to store the undesired particles to keep them from going back onto the surface 306. In various examples, the position of the collection unit 310 may vary depending on an angle at which the electromagnetic energy will move the particle.

Figure 4:
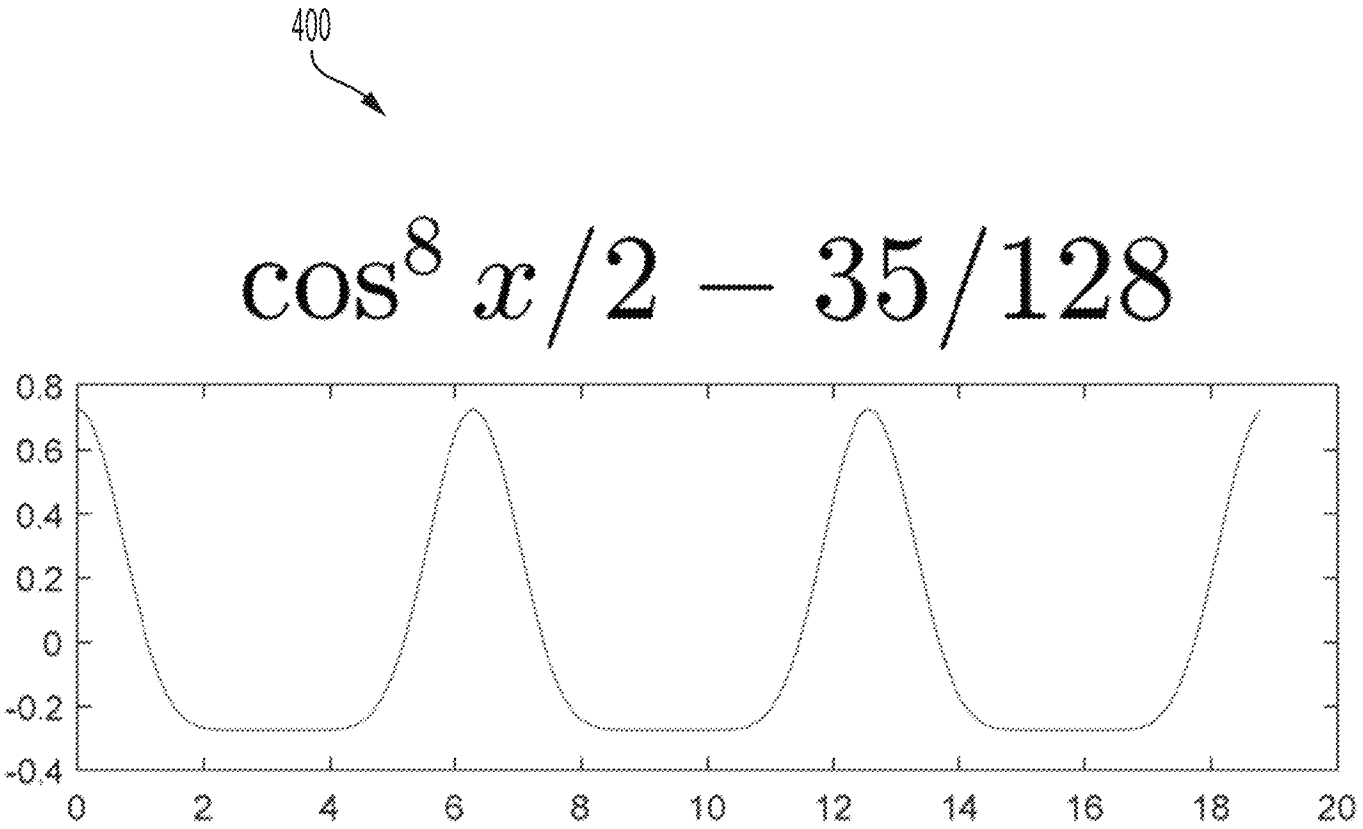
FIG. 4 illustrates an example skewed signal, according to an example embodiment.

FIG. 4 illustrates an example skewed signal 400, according to an example embodiment. As shown in FIG. 4, based on the impulse-momentum change theorem, the skewed signal 400 may have more forcing impact on particles in the positive cycle (i.e., values greater than 0) as opposed to the negative cycle (i.e., values greater than 0). Because a typical sinusoid contains approximately the same amount of forcing impact in both the positive cycle and negative cycle, it may only cause a small movement of particles. A particle may be pushed in one direction during the positive cycle and pulled in the opposite direction during the negative cycle. Therefore, it may be desirable to create a skewed signal 400 as a superposition of sinusoids to cause the skewed signal 400 to thereby cause a larger movement in particle(s) on the surface.

The maximum amount of charge that a particle may accumulate depends on the charging time, the particle size, the dielectric constant of the particle, its work function, and the performance of ionization method, for example the magnitude of the received cosmic radiation or electric field or the intensity of the impinging laser used for ionization. For a particle on a surface, the amount of charge that a particle accumulates may be simplified and assumed homogeneous based on the capacitance of the particle, or homogeneous charge density, as defined by Equation 1, where r equals the approximate radius of the particle. The charge is then given by Equation 2, where V is the voltage on the particle.

$$C=4\pi\varepsilon r \qquad \text{Equation 1}$$

$$q=CV \qquad \text{Equation 2}$$

The force on a particle is given by Equation 3, where F is the force, q is the charge, E is the electric field strength, v is the velocity of the particle and B is the magnetic field. The electric field and the magnetic field are those from the skewed signal transmitted by the antenna.

$$F=q(E+v\times B) \qquad \text{Equation 3}$$

Figure 5:
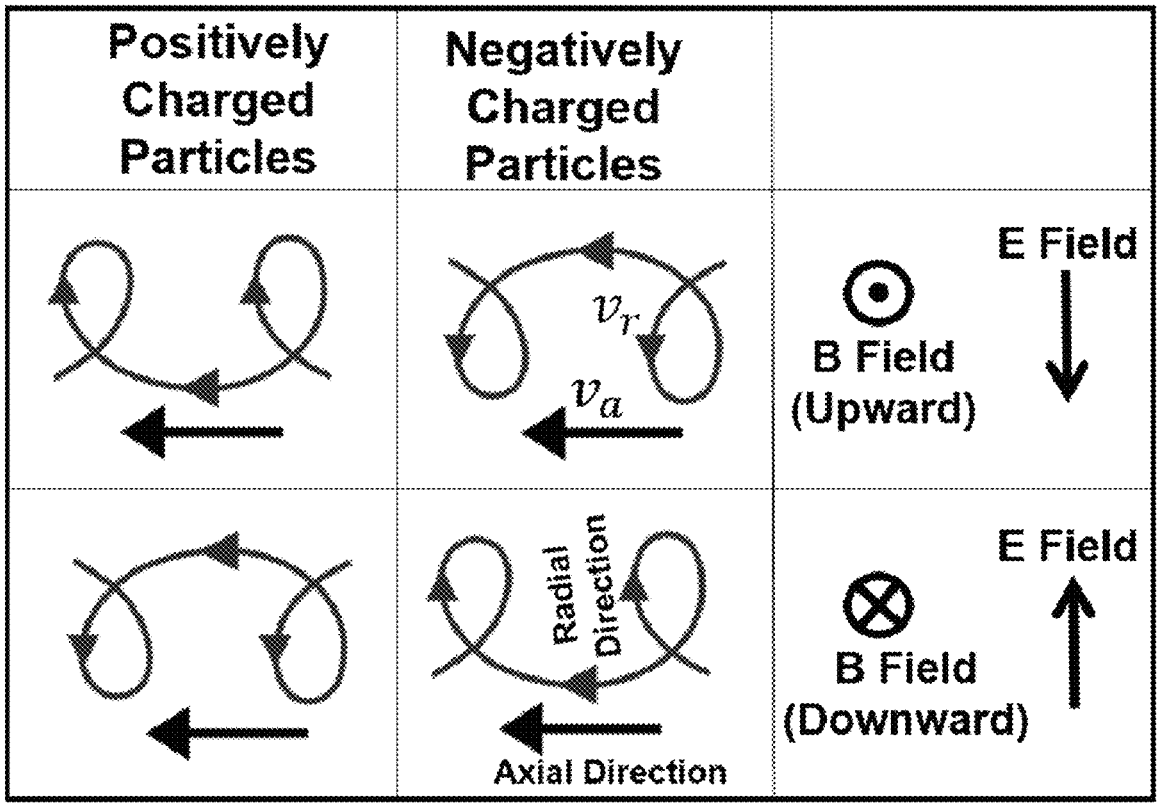
FIG. 5 illustrates an example particle movement, according to an example embodiment.

FIG. 5 illustrates an example particle movement, according to an example embodiment. Under electromagnetic excitation, and at any infinitesimal instant, the charged particles (or ions) move in a uniform circular orbit in the plane perpendicular to B and in the direction parallel to the E field (as shown in FIG. 5). The composite motion of the charged particle mimics a helical spiral motion, outward and along the direction of excitation. The moving charges also will produce fields that are considered negligible compared to the external excitation, for example an antenna 202.

The impinging electromagnetic fields transmitted by antenna 202 moves charged particles in two orthogonal directions. One direction parallel to the E field and the other one perpendicular to the B field. Assuming that the B and E fields are constant in an infinitesimally small time interval, the charged particle is forced to undergo a helical trajectory.

Benefiting from the orthogonality of the E and B fields, the formula governing instantaneous pseudo-circular motion becomes:

$$\frac{\partial r}{\partial t}=\frac{m}{q}\frac{\partial}{\partial t}\left(\frac{v_r}{B}\right) \qquad \text{Equation 4}$$

where r is the radius of circular motion in the direction parallel to the B field or radial direction, q and m are the charge amount and the mass of the particle, $v_r$ is the component of the particle speed in radial direction (parallel to the instantaneous field B). The operator ∂/∂t, is partial derivative operator with respect to time and signifies temporal variation of operand parameters.

The B field component described above displaces the particles radially, or may act to loosen the particles' bonding with the surface. Similarly, we may derive the formula for particle migration in the axial direction parallel to the E field (or perpendicular to the B field). This is the main component which sweeps the particles away from the target surface. Similarly the axial component derived from equation 3 results in an instantaneous axial speed defined by Equation 5:

$$\frac{\partial}{\partial t}v_a=\frac{\partial}{\partial t}\frac{E\times B}{B^2} \qquad \text{Equation 5}$$

Therefore the instantaneous axial speed appears independent of the polarity of the electromagnetic field, and magnitude and the sign of the charged particles. Note that the term $$\frac{\partial}{\partial t}v_a$$

signifies particle acceleration with a mass m, and together, translate to the forces on the particles, as shown in Equation 6:

$$F=m\frac{\partial}{\partial t}v_a=m\frac{\partial}{\partial t}\frac{E\times B}{B^2} \qquad \text{Equation 6}$$

For a constant power antenna system, and based on equation 6 and the impulse-momentum change theorem, we can maximize the impinging force by maximizing the temporal variation of electromagnetic field maintaining constant power. This would result in a family of skewed waveforms as exemplified.

The example skewed signal 400 of FIG. 4 may be specified by Equation 7:

$$\cos^8\left(\frac{x}{2}\right)-\frac{35}{128} \qquad \text{Equation 7}$$

A signal generator (e.g., waveform synthesizer) can be used to generate skewed waveforms. In some examples, the skewed waveforms may be generated by a synthesizer or another signal generation unit that can output a combination of sinusoids. The waveforms can also be synthesized using weighted sum of n tonal sinusoids or harmonics exemplified by Equation 8:

$$\sum_{k=1}^{n}=\frac{\sin(kx)}{k} \qquad \text{Equation 8}$$

The signal controller (such as signal controller 108 of FIG. 1A or signal controller 158 of FIG. 1B) may determine the function (such as that shown in Equation 7) to create the skewed signal 400. The skewed signal 400 may not be the signal that is ultimately transmitted by an antenna of the present system, but rather may be a baseband or base signal that is amplified and mixed before being transmitted by the antenna(s). In some other examples, different functions other than Equation 7 may be used as well. For example, the signal controller may be able to determine a function based on the size, density, or material properties of the particles.

In some examples, the signal controller may determine parameters for the skewed signal and provide the parameters to a signal generator to generate the skewed signal. The signal controller may communicate one or more coefficients (such as coefficients for a sinusoid) to the signal generator. The signal generator may responsively generate the skewed signal. In some examples, the skewed signal may be able to move a 10 micrometer particle at 0.2 meters per second and a 1 micrometer particle at 20 meters per second, compared to a traditional sinusoid providing movement at 0.04 meters per second and 4 meters per second respectively.

Figure 6:
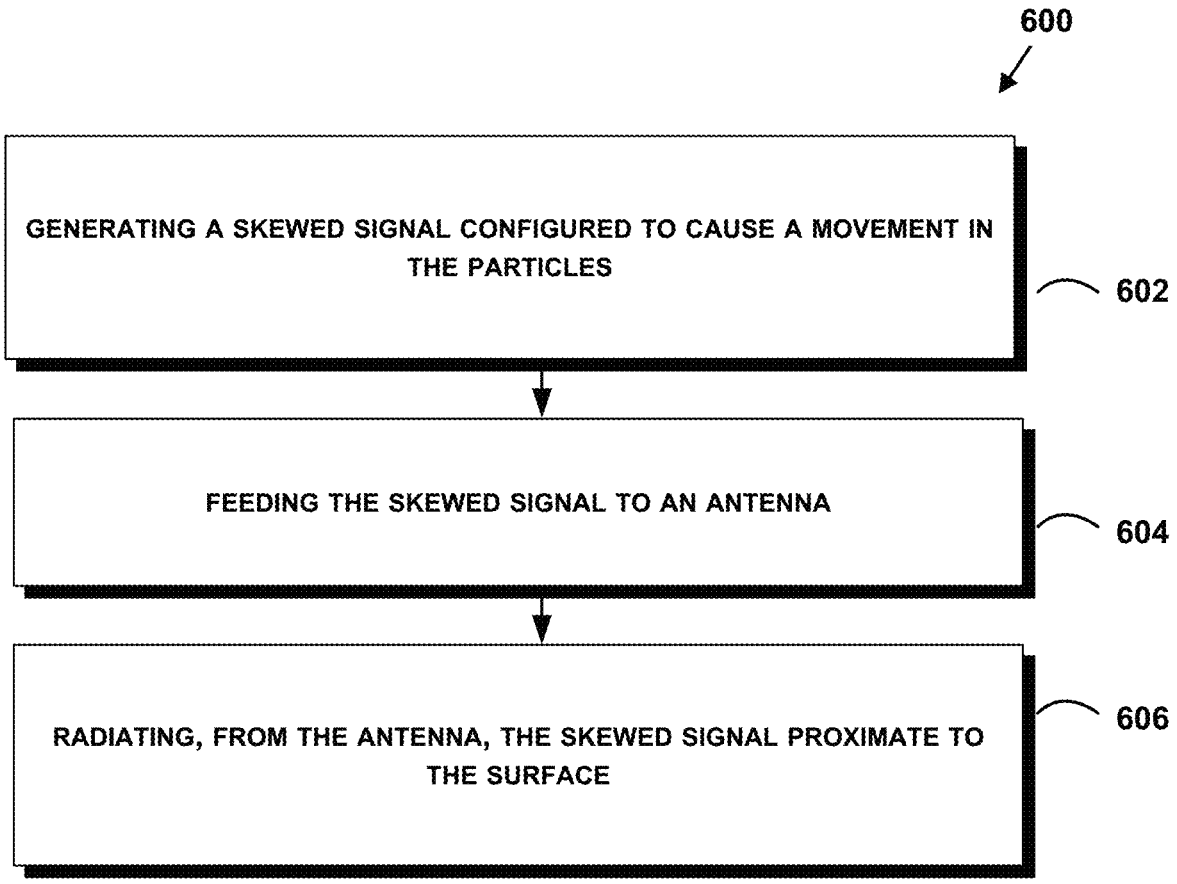
FIG. 6 shows a flowchart of an example method of operating a skewed waveforms to eject debris using electromagnetic propulsion system, according to an example embodiment.

FIG. 6 shows a flowchart of an example method of operating skewed waveforms to eject debris using electromagnetic propulsion system, according to an example embodiment. Method 600 may be used with or implemented by the systems shown in FIGS. 1-4. In some instances, components of the devices and/or systems may be configured to perform the functions such that the components are actually configured and structured (with hardware and/or software) to enable such performance. In other examples, components of the devices and/or systems may be arranged to be adapted to, capable of, or suited for performing the functions, such as when operated in a specific manner. Method 600 may include one or more operations, functions, or actions as illustrated by one or more of blocks 602-606. Also, the various blocks may be combined into fewer blocks, divided into additional blocks, and/or removed based upon the desired implementation.

It should be understood that for this and other processes and methods disclosed herein, flowcharts show functionality and operation of one possible implementation of present embodiments. Alternative implementations are included within the scope of the example embodiments of the present disclosure in which functions may be executed out of order from that shown or discussed, including substantially concurrent or in reverse order, depending on the functionality involved, as would be understood by those reasonably skilled in the art.

At block 602, the method 600 includes generating a skewed signal configured to cause a movement in the particles. As discussed with respect to FIG. 4, a skewed signal may be generated to cause a movement of particles on a surface. In some examples, the generated skewed signal may be based upon the size, density, or material properties of the particles. Additionally, the skewed signal may produce more impact in the positive cycle as opposed to the negative cycle. Alternatively, the skewed signal may have more impact in the negative cycle as opposed to the positive cycle. It may be desirable for the skewed signal to have more forcing impact in one cycle versus the other to cause a greater movement in the particles.

A processor in a signal controller may be able to determine the skewed signal based upon the particles present on the surface. In some examples, a camera or other sensor may be able to provide information about the particle(s) to the signal controller so that the signal controller may be able to generate an appropriate skewed signal. In some examples, the signal controller may determine parameters for the skewed signal and provide the parameters to a signal generator to generate the skewed signal. The signal controller may communicate one or more coefficients (such as coefficients for a sinusoid) to the signal generator. The signal generator may responsively generate the skewed signal.

Additionally, in some examples, block 602 may generate multiple skewed signals in examples where the system includes a plurality of antennas. However, in other examples with a plurality of antennas, block 602 may generate a single skewed signal. When there are multiple antennas, block 602 may also include adding a relative phasing to the skewed signals. The relative phasing may cause a beam transmitted by the plurality of antennas to adjust its angular position. The signal controller may apply a phasing across the signals in order to steer the beam to a given portion of the surface. In some examples, the signal controller may determine a location to steer the beam, such as a location of debris or a predetermined sweeping pattern, and responsively adjust the relative phasing.

At block 604, the method 600 includes feeding the skewed signal to an antenna. The skewed signal generated at block 602 may be fed to an antenna by way of an amplifier located between the signal generator and the antenna. The amplifier may increase a power level of the skewed signal to that the skewed signal has enough energy to cause a movement in the particles.

At block 606, the method 600 includes radiating, from the antenna, the skewed signal proximate to the surface. Block 606 may include radiating the skewed signal from a single antenna or from a plurality of antennas. The radiating may be performed based on a radiation pattern of the antenna (or plurality of antennas). The radiation pattern may be at an angle to mitigate a percentage of the radiated energy that strikes a sensor, but does strike particles on a surface of or near the sensor. Once the energy is radiated, it will strike at least one undesired particle on the surface and cause the particle to move. It may be desirable to cause the particle to move off the surface. In some examples, block 606 may also include electrostatically trapping the particles in a collection unit.

Additionally, as part of method 600, in conjunction with one or more of blocks 602-606, the method may include operating a laser to shine a laser beam on the surface. In some examples, the laser may operate in one of two modes. In the first mode, the laser may loosen the particles on the surface through laser ablation. In the second mode, the laser may ionize the particles on the surface. The laser may selectively operate in the two modes based on a signal from a laser controller. In some examples, the laser may operate in the first mode to loosen particles then operate in the second mode to ionize the particles it has loosened. In another example, the laser may only operate in the second mode to ionize particles present on the surface.

The description of the different advantageous arrangements has been presented for purposes of illustration and description, and is not intended to be exhaustive or limited to the embodiments in the form disclosed. Many modifications and variations will be apparent to those of ordinary skill in the art. Further, different advantageous embodiments may describe different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method for clearing particles from a surface of an electronic device, the method comprising:

generating a skewed signal configured to cause a movement in the particles, wherein the skewed signal is generated by a superposition of sinusoids;

feeding the skewed signal to an antenna; and radiating, from the antenna, the skewed signal in a direction relative to the surface such that the skewed signal moves the particles from the surface.

2. The method of claim 1, wherein said generating the skewed signal is based on a size of the particles.

3. The method of claim 1, wherein said radiating is based on a radiation pattern of the antenna that minimizes energy radiated into the surface.

4. The method of claim 1, further comprising using a laser to loosen the particles on the surface.

5. The method of claim 1, further comprising using a laser to ionize the particles on the surface.

6. The method of claim 1, further comprising selectively operating a laser in one of two modes, wherein a first mode comprises loosening the particles on the surface and a second mode comprises ionizing the particles on the surface.

7. The method of claim 1, further comprising using a collection unit to electrostatically trap the particles.

8. The method of claim 1, wherein the direction relative to the surface is a direction that is approximately parallel to a plane of the surface.

9. A method for clearing particles from a surface of an electronic device, the method comprising:

determining a size of the particles;

generating a skewed signal configured to cause a movement in the particles based, at least in part, on the determined size;

feeding the skewed signal to an antenna; and radiating, from the antenna, the skewed signal in a direction relative to the surface such that the skewed signal moves the particles from the surface.

10. The method of claim 9, further comprising selectively operating a laser in one of two modes, wherein a first mode comprises loosening the particles on the surface and a second mode comprises ionizing the particles on the surface.

11. The method of claim 9, further comprising using a collection unit to electrostatically trap the particles.

12. The method of claim 9, wherein the direction relative to the surface is approximately parallel to a plane of the surface.

13. The method of claim 9, further comprising using a laser to loosen the particles on the surface.

14. The method of claim 9, further comprising using a laser to ionize the particles on the surface.

15. A method of clearing particles from a surface of an electronic device, the method comprising:

using a laser to loosen the particles on the surface;

generating a skewed signal configured to cause a movement in the particles;

feeding the skewed signal to an antenna; and radiating, from the antenna, the skewed signal in a direction relative to the surface such that the skewed signal moves the particles from the surface.

16. The method of claim 15, further comprising using the laser to ionize the particles on the surface.

17. The method of claim 15, further comprising ionizing the particles on the surface.

18. The method of claim 15, further comprising using a collection unit to electrostatically trap the particles.

19. The method of claim 15, wherein the direction relative to the surface is approximately parallel to a plane of the surface.

20. The method of claim 15, wherein the electronic device comprises a sensor or a solar panel, and wherein said radiating comprises radiating the skewed signal in a direction relative to the sensor or the solar panel.

* * * * *